US010548424B1

(12) United States Patent
Ahlstrom

(10) Patent No.: US 10,548,424 B1
(45) Date of Patent: Feb. 4, 2020

(54) DEVICE AND SYSTEM FOR HOLDING A DRINKING CONTAINER AND METHOD OF USE

(71) Applicant: Daniel Darrel Ahlstrom, Richfield, MN (US)

(72) Inventor: Daniel Darrel Ahlstrom, Richfield, MN (US)

( * ) Notice: Subject to any disclaimer, the term of this patent is extended or adjusted under 35 U.S.C. 154(b) by 0 days.

(21) Appl. No.: 15/822,687

(22) Filed: Nov. 27, 2017

(51) Int. Cl.
*A47G 23/02* (2006.01)

(52) U.S. Cl.
CPC ..... *A47G 23/0216* (2013.01)

(58) Field of Classification Search
CPC ..... Y10T 16/4707; Y10T 16/4713; A47G 23/0216; A47G 23/0266; A47G 23/0291; A47G 23/02; A47G 23/0208; A47G 23/0241; B65D 81/3876; B65D 81/3879; A45F 2200/0583; A45F 2005/1073; A45F 5/102
USPC .... 220/737, 738, 741, 742, 739, 759, 710.5, 220/756, 770; 294/27.1, 33
See application file for complete search history.

(56) References Cited

U.S. PATENT DOCUMENTS 1,118,395 A * 11/1914 Campbell
D195,985 S * 8/1963 Scherrer ..... D7/622
3,261,633 A * 7/1966 Sakuta ..... A47G 23/0266 294/16
5,788,298 A * 8/1998 Cheng ..... A47G 23/0216 220/738
7,097,223 B1 * 8/2006 Bradford ..... A45F 5/1026 294/137
9,451,821 B1 * 9/2016 Estigoy ..... A45F 5/021
9,669,963 B2 * 6/2017 Shirley ..... B65D 1/02
2005/0184078 A1 * 8/2005 Oas ..... A47G 19/2227 220/756
2006/0022476 A1 * 2/2006 Caputi ..... A45C 13/30 294/153
2008/0078787 A1 * 4/2008 Yelland ..... A45F 3/16 224/148.1
2013/0200087 A1 * 8/2013 Mango ..... A47G 23/0216 220/710.5

FOREIGN PATENT DOCUMENTS

CA 2776448 A1 * 11/2013 ..... A45F 5/10
FR 2842080 A1 * 1/2004 ..... A44B 11/06

* cited by examiner

*Primary Examiner* — Allan D Stevens
(74) *Attorney, Agent, or Firm* — Ted Masters

(57) ABSTRACT

A device for holding a drinking container removably attaches to the drinking container. The drinking container has an outside surface and cooperates with a sleeve which is disposed around the outside surface of the drinking container, the sleeve having an outside surface and an inside surface. The device includes a handle and a retainer. The retainer has a proximal end which is connected to the handle and an opposite distal end. The retainer is positionable between the outside surface of the drinking container and the inside surface of the sleeve. In one embodiment a connector is configured to removably connect the distal end of the retainer to the handle.

1 Claim, 9 Drawing Sheets

FIG. 4
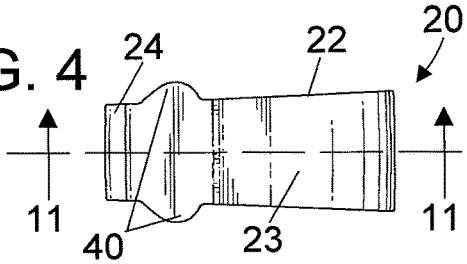
FIG. 7
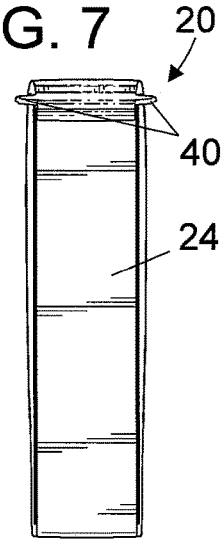
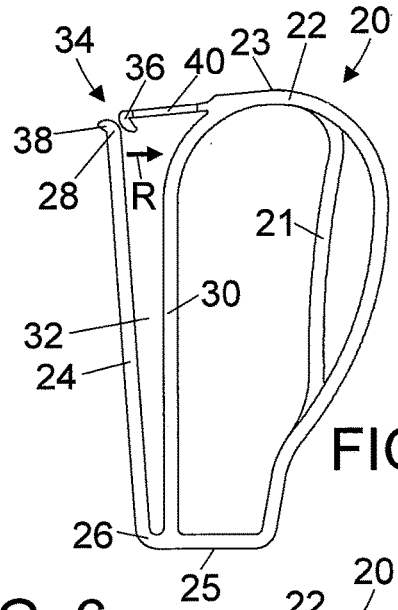
FIG. 5
FIG. 8
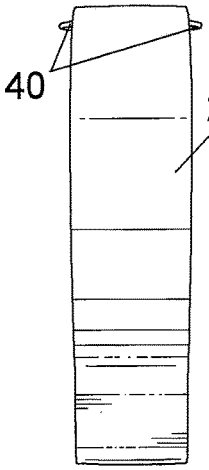
FIG. 6
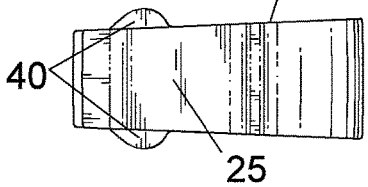
FIG. 9
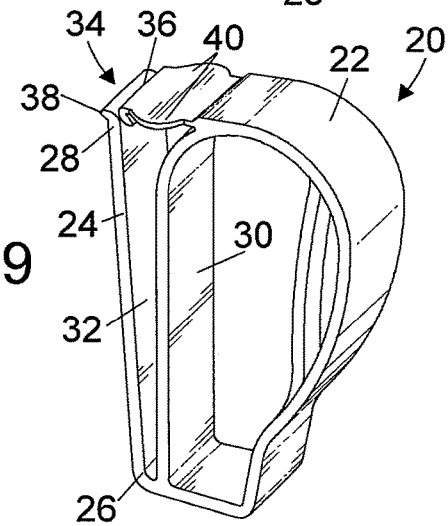

FIG. 10
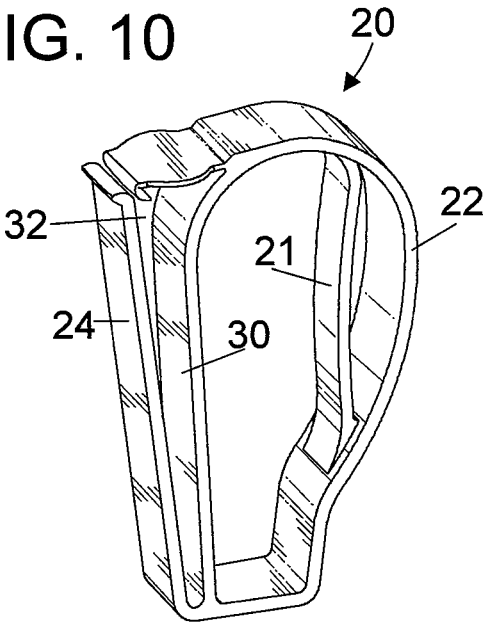
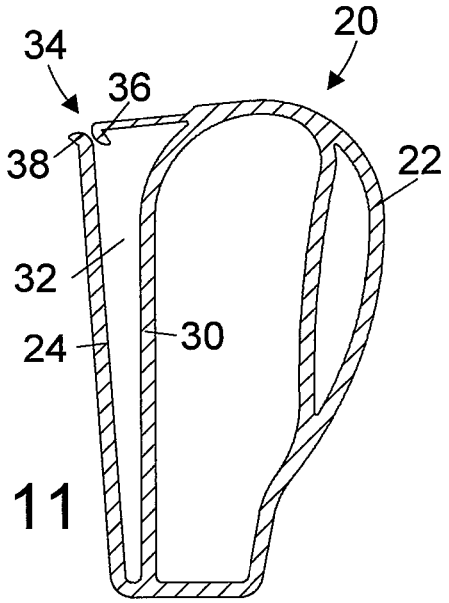
FIG. 11
FIG. 12
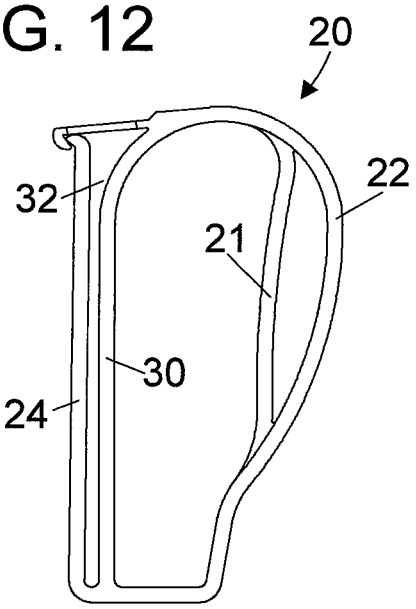
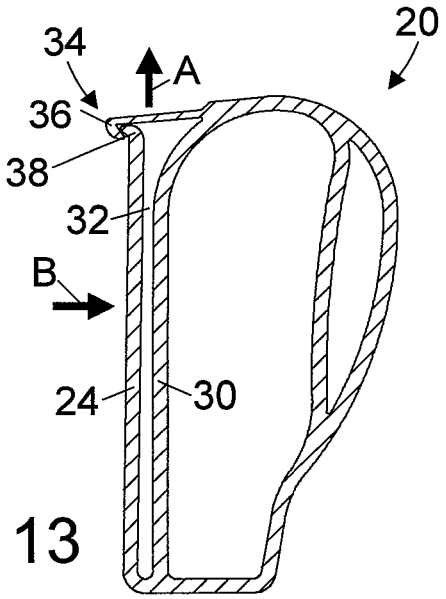
FIG. 13

DEVICE AND SYSTEM FOR HOLDING A DRINKING CONTAINER AND METHOD OF USE

CROSS REFERENCE TO RELATED APPLICATION

None

TECHNICAL FIELD

The present invention pertains generally to drinking containers, and more particularly to a device having a handle which attaches to the drinking container.

BACKGROUND OF THE INVENTION

Drinking containers which hold consumable liquids are well known in the art. Such containers include full open mouthed containers such as glasses and cups, as well as partially open mouthed containers such as cans and bottles. The drinking containers can be of various shapes such as cylindrical, square, hexagonal, octagonal, frustoconical (tapered) or other shapes. It is also know to place a close-fitting sleeve around the drinking container. The sleeve serves as an insulator to both maintain the temperature of the beverage within the container, and in the case of hot beverages, to protect the hand of a user from possible burns. The sleeves are typically made from foam, neoprene, polyester, vinyl or the like and are somewhat elastic so that they grip the drinking container. Other sleeve materials can include paper or fabric. The outside surface of the sleeves can contain advertising or other indicia.

BRIEF SUMMARY OF THE INVENTION

The present invention is directed to a device which includes a handle for holding a drinking container. The device removably connects to the drinking container. The connection is made via a sleeve which is disposed around the outside surface of the drinking container. The device has a retainer which is positionable between the drinking container and the sleeve. In an embodiment the retainer can be connected to the handle so that the sleeve is captively engaged.

In accordance with an embodiment, a device for holding a drinking container is disclosed. The drinking container has an outside surface. The drinking container cooperates with a sleeve which is disposed around the outside surface of the drinking container. The sleeve has an outside surface and an inside surface. The device includes a handle which is connected to a retainer. The retainer has a proximal end which is connected to the handle and an opposite distal end. The retainer is positionable between the outside surface of the drinking container and the inside surface of the sleeve.

In accordance with another embodiment, the distal end of the retainer is resiliently movable away from the handle.

In accordance with another embodiment, the retainer is a wall.

In accordance with another embodiment, a connector is configured to removably connect the distal end of the retainer to the handle.

In accordance with another embodiment, the connector includes a first hook disposed on the handle, and a second hook disposed at the distal end of the retainer. The first and second hooks have an engaged position wherein the distal end of the retainer is connected to the handle, and a disengaged position wherein the distal end of the retainer is disconnected from the handle.

In accordance with another embodiment, the connector includes a lifting tab for lifting the first hook to place the first and second hooks in the disengaged position.

In accordance with another embodiment, the sleeve has an aperture. The connector is positionable through the aperture in the sleeve.

In accordance with another embodiment, a second retainer is connected to the handle, the second retainer is configured to abut the outside surface of the sleeve.

In accordance with another embodiment, the second retainer is a wall.

In accordance with another embodiment, the retainer and the second retainer form a space therebetween which is configured to receive the sleeve.

In accordance with another embodiment, the handle has a flat bottom.

In accordance with another embodiment, the sleeve has a top rim and an opposite bottom rim and a height therebetween. The retainer has a length which is greater than the height between the top rim and the bottom rim of the sleeve.

Other embodiments, in addition to the embodiments enumerated above, will become apparent from the following detailed description, taken in conjunction with the accompanying drawings, which illustrate, by way of example, the principles of the device for holding a drinking container and method of use.

BRIEF DESCRIPTION OF THE DRAWINGS

FIG. 4 is a top plan view of the device;

FIG. 5 is a front elevation view of the device, the rear elevation view being the mirror image;

FIG. 6 is a bottom plan view of the device;

FIG. 7 is a side elevation view of the device;

FIG. 8 is an opposite side elevation view of the device;

FIG. 9 is a perspective view of the device;

FIG. 10 is an opposite perspective view of the device;

FIG. 11 is a cross sectional view along the line 11-11 of FIG. 4;

FIG. 12 is a front elevation view of the device with a connector in an engaged position;

FIG. 13 is a cross sectional view along the line 11-11 of FIG. 4 but with the connector w moved to the engaged position;

DETAILED DESCRIPTION OF THE INVENTION

Figure 1:
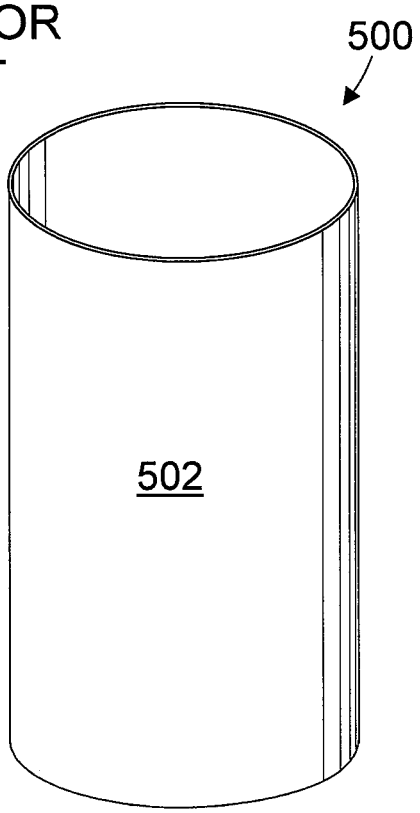
FIG. 1 PRIOR ART
FIG. 1 is a perspective view of a prior art drinking container.

Referring initially to FIG. 1, there is illustrated a perspective view of a prior art drinking container, generally designated as 500. In the shown embodiment drinking container 500 is a glass which has a generally cylindrical shape. However, it may be appreciated that drinking container 500 could also be a cup, a can, or a bottle; could have a shape other than cylindrical such as square, hexagonal, or frustoconical; and can be full open mouthed (glass or cup) or partially open mouthed (such as a can or a bottle). Drinking container 500 has an outside surface 502.

Figure 2:
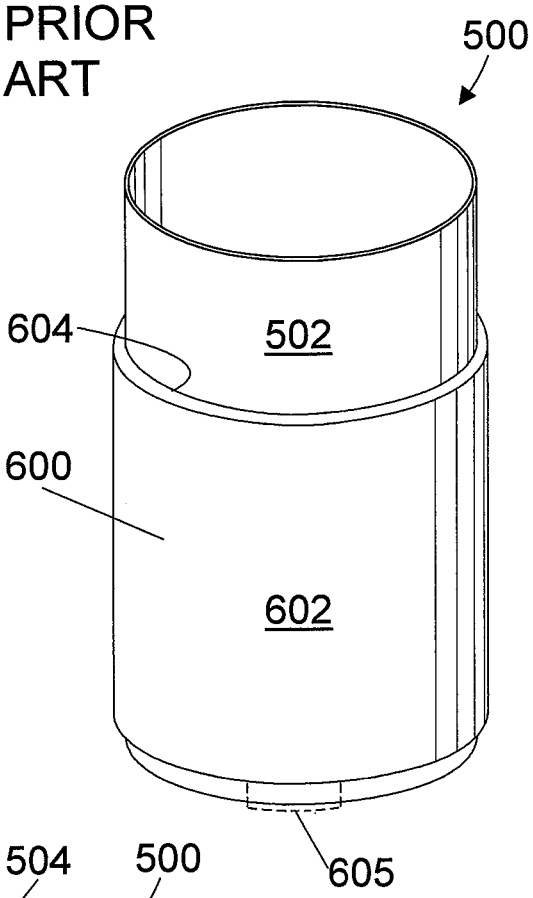
FIG. 2 PRIOR ART
FIG. 2 is a perspective view of the drinking container with a prior art sleeve disposed around the container.
Figure 16:
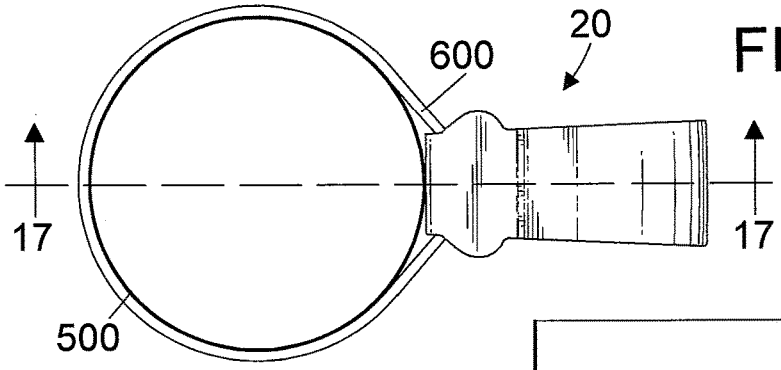
FIG. 16 is a top plan view of the device connected to the sleeve and drinking container.
Figure 18:
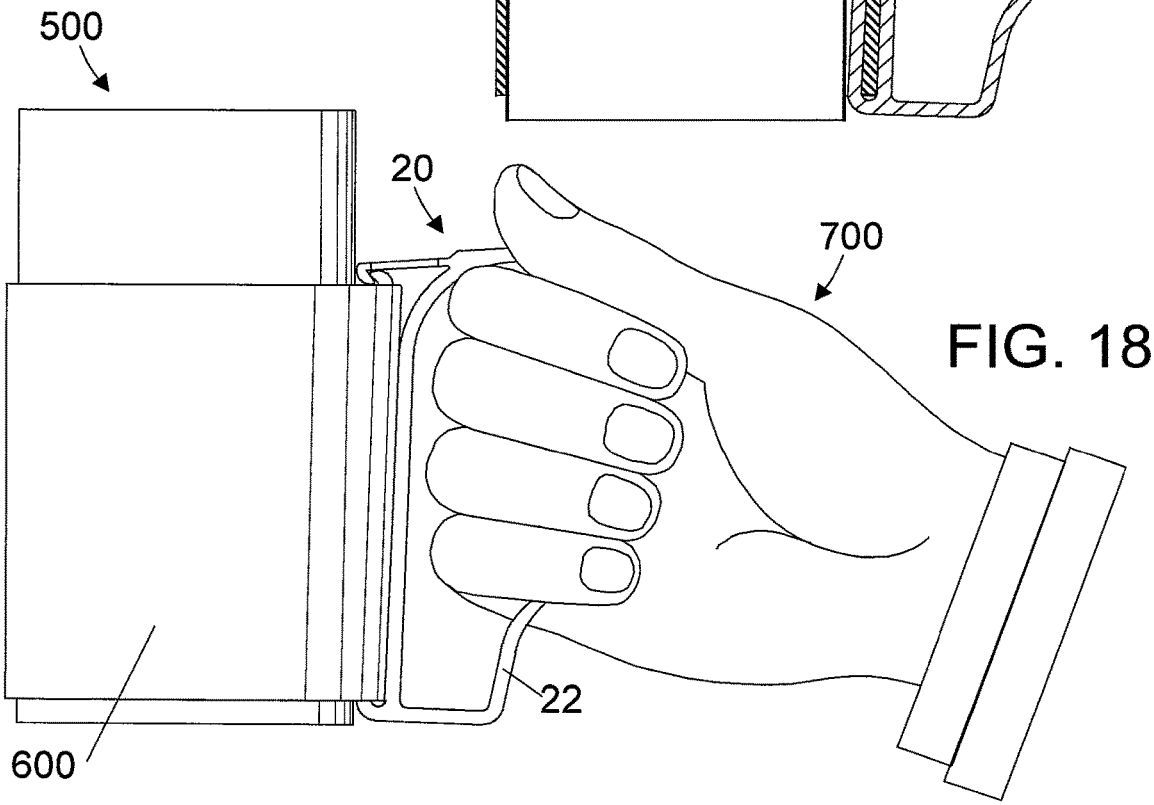
FIG. 18 is a side elevation view of the device connected to the sleeve and drinking container, and a handle being gripped by the hand of a user.

FIG. 2 is a perspective view of drinking container 500 with a prior art sleeve 600 disposed around the outside surface 502 of the container. In the shown embodiment sleeve 600 closely fits the outside surface of drinking container 500 and is elastic (made from a resilient material) so that it grips the container. Sleeve 600 has an outside surface 602 and an opposite inside surface 604 which abuts the outside surface 502 of drinking container 500. Some sleeves 600 include a band 605 which abuts the bottom of drinking container 500 (band 605 shown in dashed lines). In FIGS. 2, 16 and 18 it is noted that sleeve 600 girdles drinking container 500.

Figure 3:
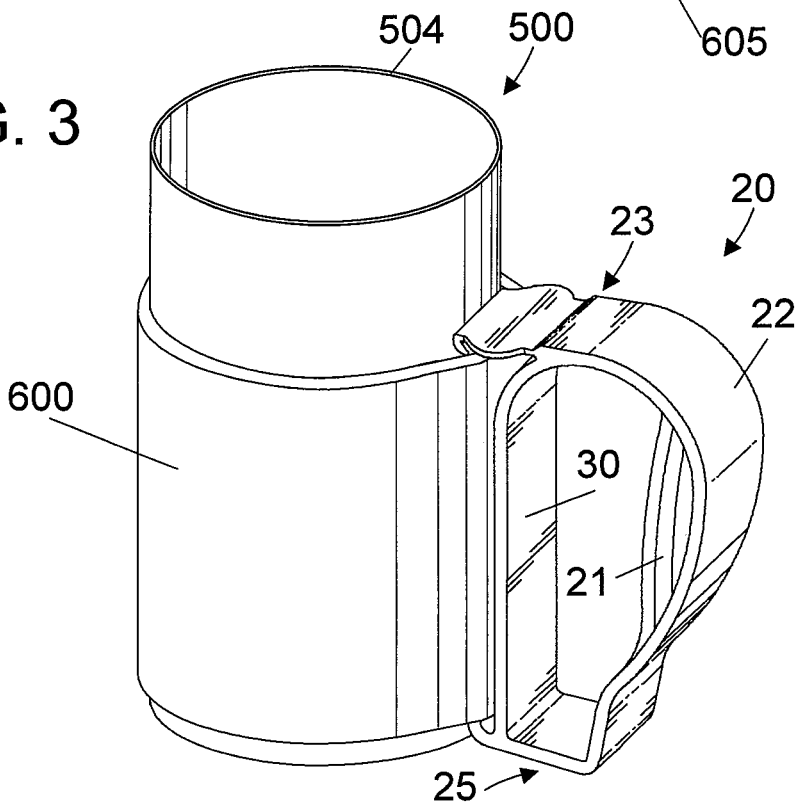
FIG. 3. is a perspective view of the drinking container and sleeve with a device for holding the container.

FIG. 3. is a perspective view of drinking container 500 and sleeve 600 with a device for holding the drinking container 500 and sleeve 600 combination, the device generally designated as 20. FIGS. 4-13 show various views of device 20. Device 20 includes a handle 22 which in the shown embodiment is curved, and is shaped and dimensioned to receive the hand 700 of a user (refer also to FIG. 18). Handle 22 has a top 23 and a bottom 25. In an embodiment, bottom 25 is flat so that it can reside upon a flat support surface 800 such as a table (refer to FIG. 15). In an embodiment, handle 22 also includes a boss 21 which effectively widens the handle to provide a better grip. Handle 22 can be fabricated from a polymer such as ABS, nylon, or the like.

Device 20 further includes a retainer 24 which has a proximal end 26 which is connected to handle 22 (fixedly connected in the shown embodiment) and an opposite distal end 28. Retainer 24 is positionable between the outside surface 502 of drinking container 500 and the inside surface 604 of sleeve 600 (refer to FIG. 17). That is, distal end 28 of retainer 24 is inserted between the outside surface 502 of drinking container 500 and the inside surface 604 of sleeve 600, and moved between the container and sleeve (in an upward direction U as shown), until the distal end 28 of retainer 24 is visible (refer to FIGS. 14 and 15).

Figure 14:
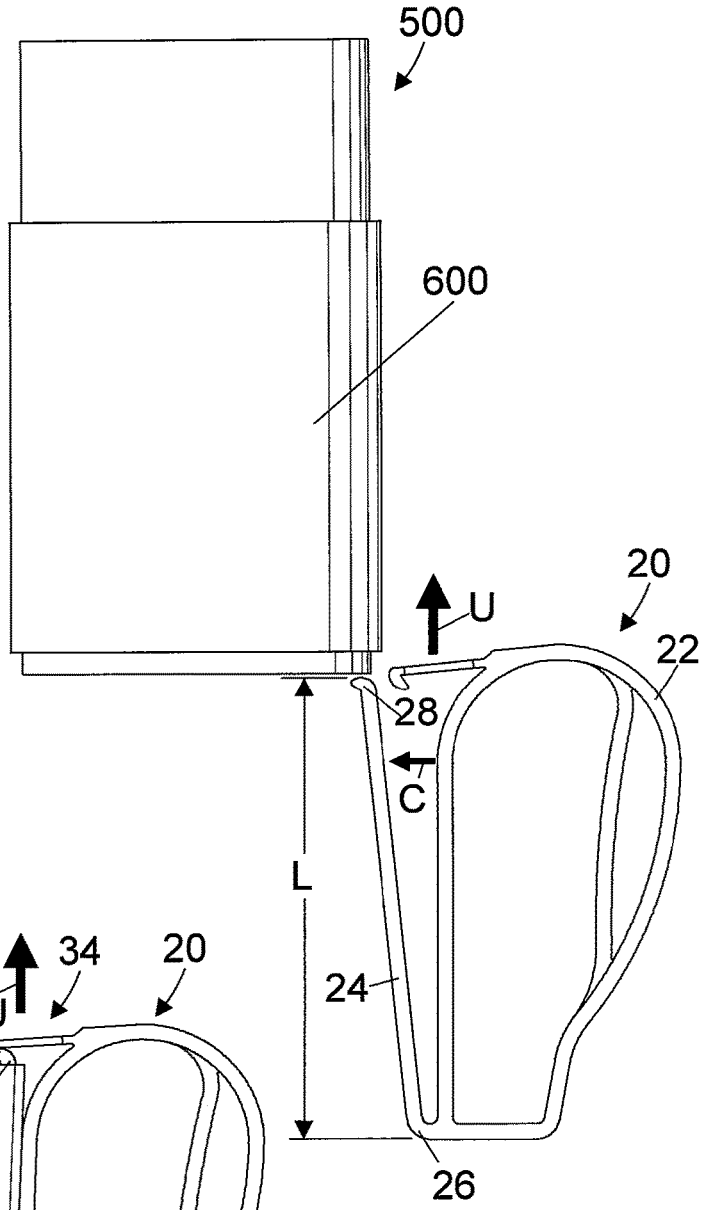
FIG. 14 is a front elevation view of the device being connected to the sleeve and drinking container.
Figure 17:
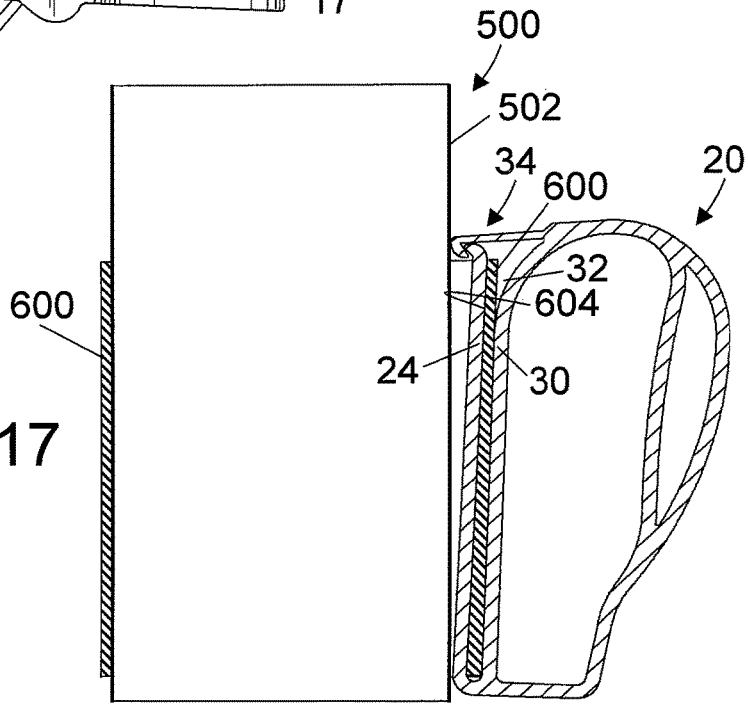
FIG. 17 is a cross sectional view along the line 17-17 of FIG. 16.

In the shown embodiment, retainer 24 is a wall. Referring to FIG. 14, distal end 28 of retainer 24 is resiliently movable away from 22 handle. This is to allow retainer 24 to be inserted between the outside surface 502 of container 500 and the inside surface 602 of sleeve 600 (refer to 14). That is, retainer 24 is resiliently biased (in direction R) to the position of FIG. 5, but can be moved away (in direction C) from handle 22 as shown in FIG. 14 to effect the insertion process. Device 30 further includes a second retainer 30 which is connected to handle 22, second retainer 30 is configured to abut the outside surface 602 of sleeve 600. In the shown embodiment, second retainer 30 is a wall which extends from the top of the handle 23 to the bottom of the handle 25 (refer to FIG. 5). Retainer 24 and second retainer 30 form a space 32 therebetween which is configured to receive sleeve 600. Referring to FIG. 17, retainer 24 is inserted between the outside surface 502 of container 500 and the inside surface 604 of sleeve 600 so that a longitudinal segment of sleeve 600 is disposed within space 32.

Device 20 further includes a connector 34 which is configured to removably connect distal end 28 of retainer 24 to handle 22 to lock device 20 to sleeve 600 (refer to FIG. 3). In the shown embodiment, connector 34 includes a first hook 36 disposed on a protuberance extending from handle 22, and a second hook 38 disposed at distal end 28 of retainer 24. First hook 36 and second hook 38 have an engaged position (refer to FIGS. 12, 13, and 15) wherein distal end 28 of retainer 24 is connected to handle 22, and a disengaged position wherein distal end 28 of retainer 24 is disconnected from handle 22 (refer to FIGS. 5, 9, and 11). When retainer 24 is moved toward handle 22, first 36 hook 36 and second hook 38 snap together into the engaged position. It is further noted that in the shown embodiment connector 34 is disposed at the top of handle 22. However it may be appreciated that retainer 24 could be inverted and connector 34 could be placed at the bottom of handle 22 adjacent bottom 25. It may also be appreciated that other connector 34 implementations are also possible, for example magnetic, hook and loop, a snap, or other mechanical connectors.

Connector 34 includes a lifting tab 40 for lifting first hook 36 to place first hook 36 and second hook 38 in the disengaged position. In the shown embodiment there are two lifting tabs 40 which outwardly project in opposite directions. When lifting tab 40 is moved away from distal end 28 of retainer 24 (moved up as shown), first hook 36 disengages from second hook 38 (refer to FIG. 13 and the associated discussion).

FIG. 11 is a cross sectional view along the line 11-11 of FIG. 4 which shows connector 34 in the disengaged position, and FIG. 13 is a cross sectional view as in FIG. 11 with connector 34 in an engaged position. To transition from the engaged position of FIG. 13 to the disengaged position of FIG. 11, in FIG. 13 lifting tab 40 is moved away from distal end 28 of retainer 24 (up as shown by direction A) and simultaneously retainer 24 is moved toward handle 22 (to the right as shown by direction B). The movement in directions A and B serve to disengage the two hooks. The movement in direction B can be effected by pushing handle 22 toward drinking container 500 (refer to FIG. 15).

Figure 15:
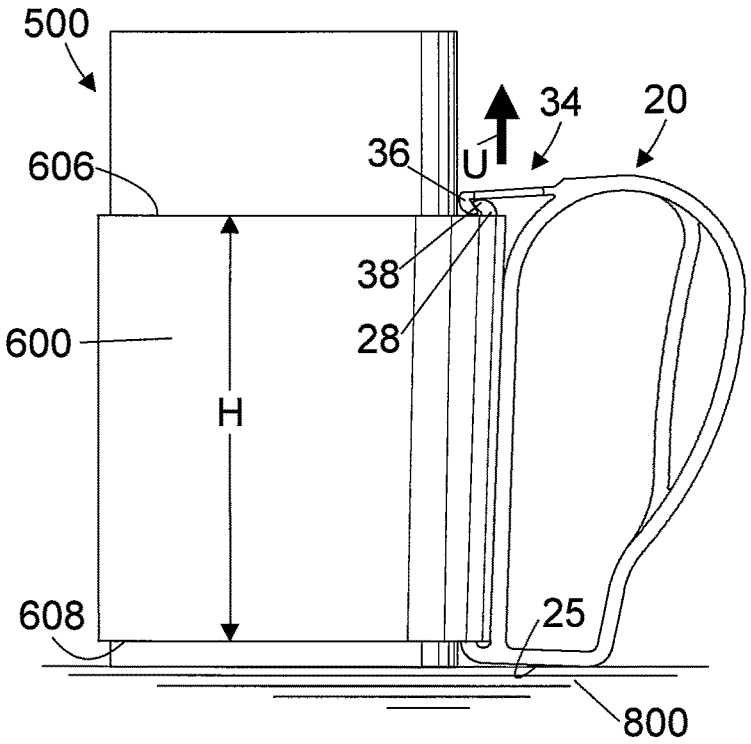
FIG. 15 is a front elevation view of the device connected to the sleeve and drinking container.

FIG. 14 is a front elevation view of device 20 being connected to sleeve 600 and drinking container 500, and FIG. 15 is a front elevation view of device 20 connected to sleeve 600 and drinking container 500. Retainer 24 is inserted between sleeve 600 and drinking container 500 and moved in direction U. To facilitate the insertion, retainer 24 is first moved outward (in the direction of arrow C) to effect a separation at distal end 28. This makes it easier to insert distal end 28 between sleeve 600 and drinking container 500. Once retainer 24 is fully inserted, connector 34 is placed in the engaged position of FIG. 15 by causing first hook 36 to engage second hook 38 (by moving retainer 24 toward handle 22).

In FIG. 15, distal end 28 has been moved up along a longitudinal segment of sleeve 600 in direction U. Sleeve 600 has a top rim 606 and an opposite bottom rim 608 and a height H therebetween. Retainer 24 has a length L (refer to FIG. 14) which is greater than the height H between the top rim 606 and the bottom rim 608 of sleeve 600. This relationship ensures that retainer 24 is long enough so that connector 34 can be placed in the engaged position. It is noted in FIGS. 15, 9, and 17 that proximal end 26 of retainer 24 is disposed adjacent the bottom rim 608 of sleeve 600 and that distal end 28 of retainer 24 is disposed adjacent the top rim 606 of sleeve 600.

FIG. 16 is a top plan view of device 20 connected to sleeve 600 and drinking container 500, and FIG. 17 is a cross sectional view along the line 17-17 of FIG. 16. Sleeve 600 expands slightly to receive retainer 24, and is disposed in space 32 between retainer 24 and second retainer 30. Connector 34 locks device 20 to sleeve 600 and thereby also to drinking container 500.

FIG. 18 is a side elevation view of device 20 connected to sleeve 600 and drinking container 500, and handle 22 being gripped by the hand 700 of a user. Device 20 transforms a handleless drinking container 500 into one which has a handle.

Figure 19:
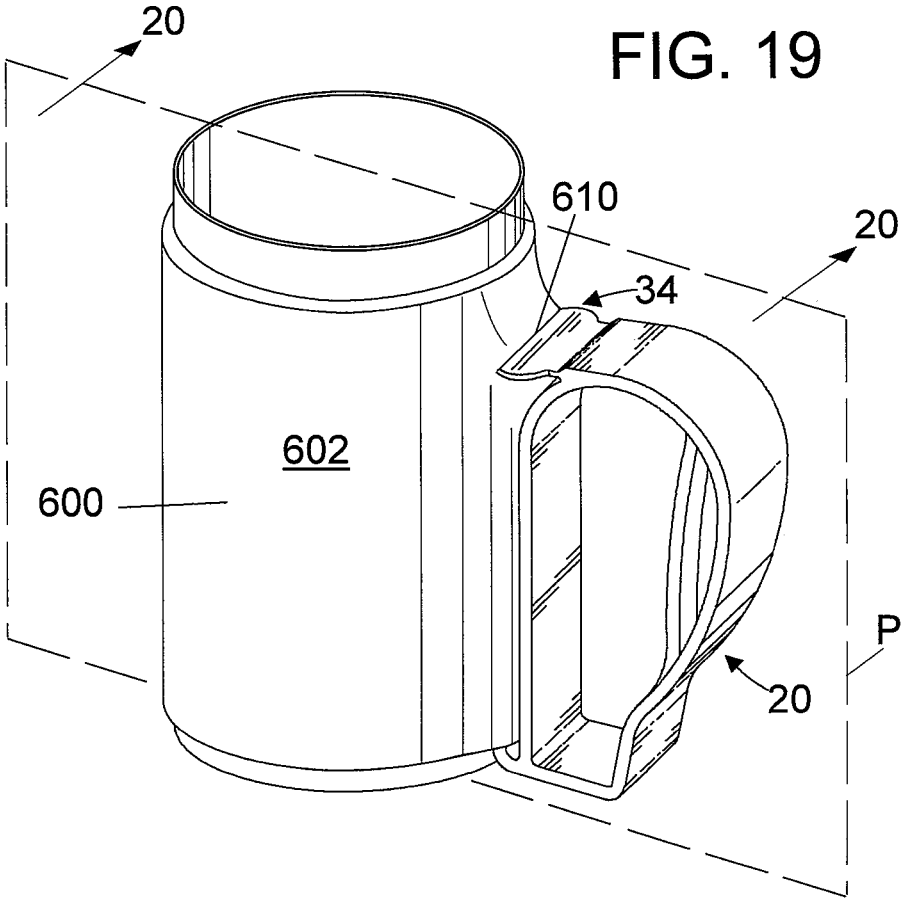
FIG. 19 is a perspective view of the connector positioned through an aperture in the sleeve.
Figure 20:
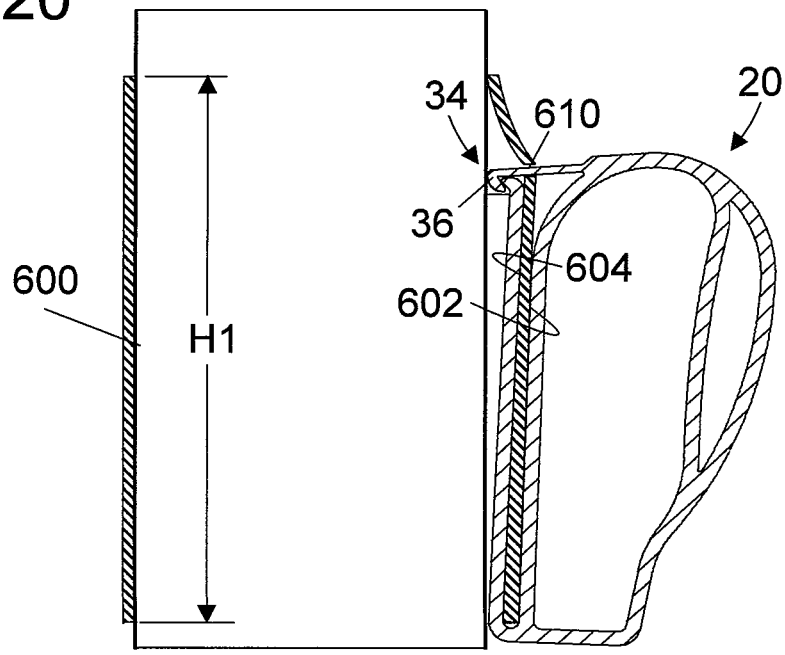
FIG. 20 is a cross sectional view in plane P of FIG. 19.

FIG. 19 is a perspective view of first hook 36 of connector 34 positioned through an aperture 610 in sleeve 600, and FIG. 20 is a cross sectional view in plane P of FIG. 19 showing connector 34 positioned through aperture 610 in sleeve 600. In the shown embodiment aperture 610 is a slot which extends from the outside surface 602 to the inside surface 604 of sleeve 600. Connector 34, and in particular first hook 36 is positionable through aperture 610 in sleeve 600. This embodiment is useful to allow connection of handle 22 when the height H1 of sleeve 600 is greater than the length of retainer 24.

Figure 21:
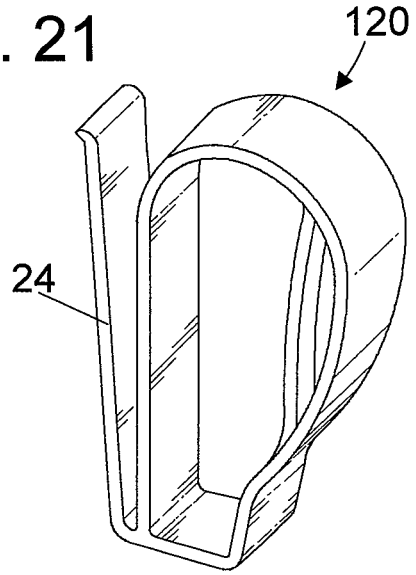
FIG. 21 is perspective view of an embodiment of the device without the connector.
Figure 22:
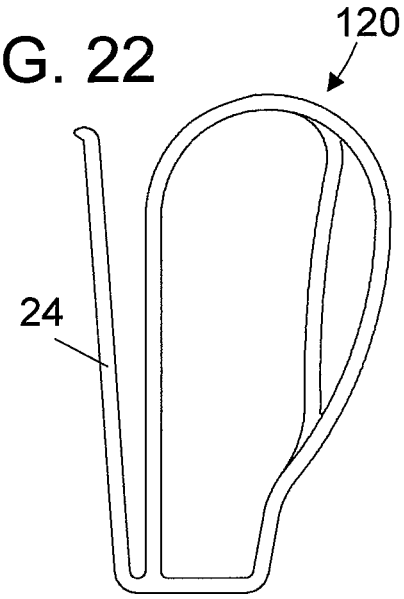
FIG. 22 is a front elevation view of the device of FIG. 21
Figure 23:
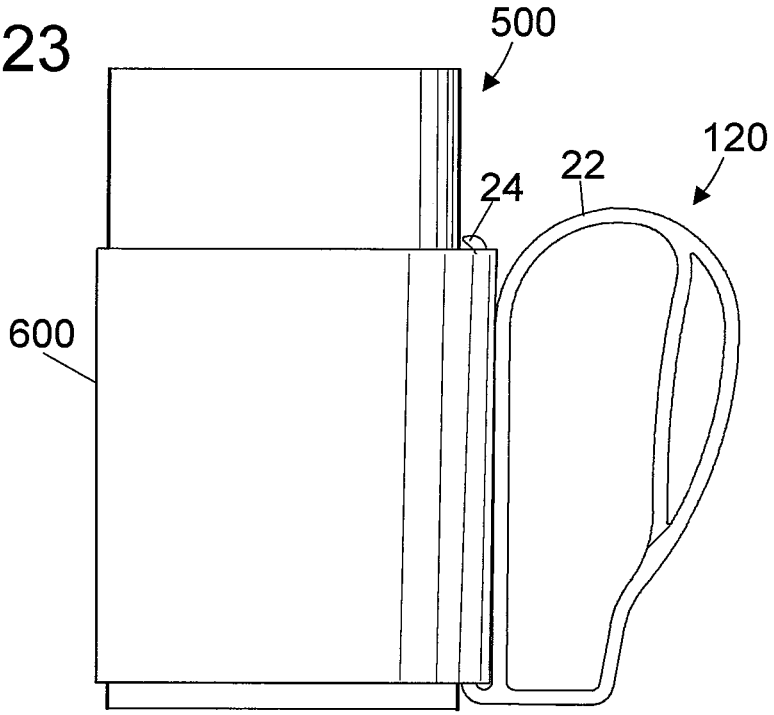
FIG. 23 is a front elevation view showing the device of FIG. 21 and the sleeve and drinking container.
Figure 24:
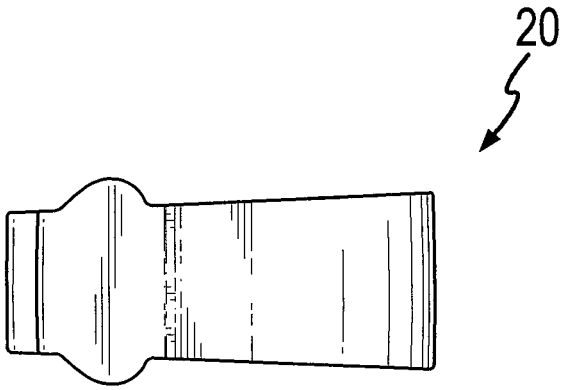
FIG. 24 is an enlarged top plan view of the device.
Figure 25:
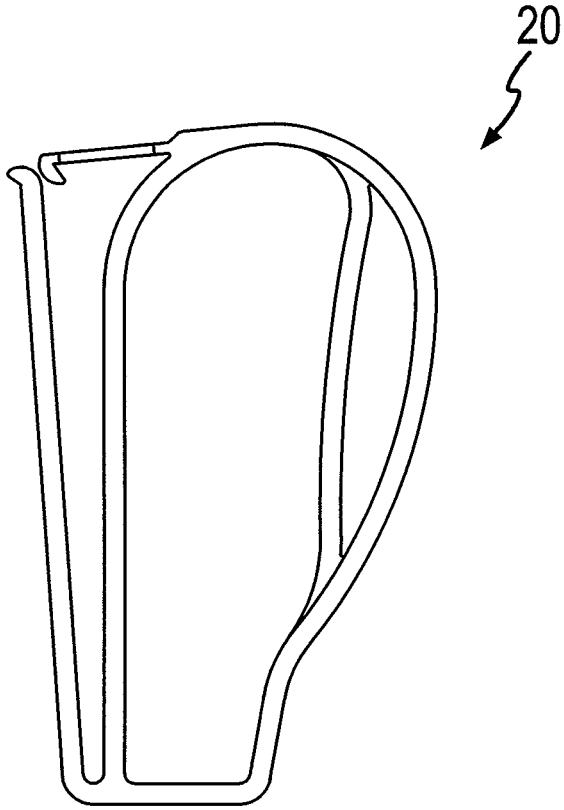
FIG. 25 is an enlarged front elevation view of the device.
Figure 26:
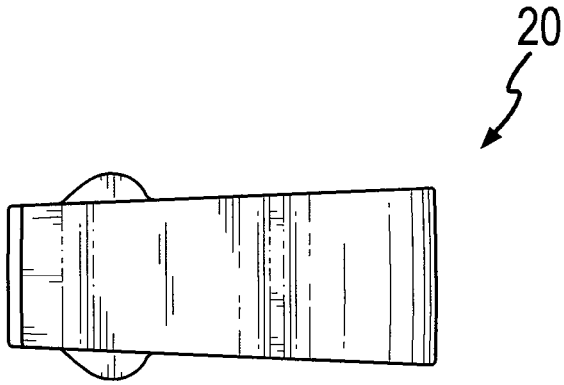
FIG. 26 is an enlarged bottom plan view of the device.
Figure 27:
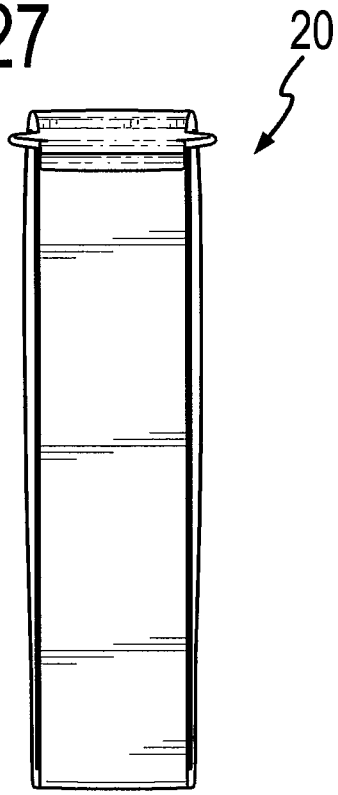
FIG. 27 is an enlarged side elevation view of the device.
Figure 28:
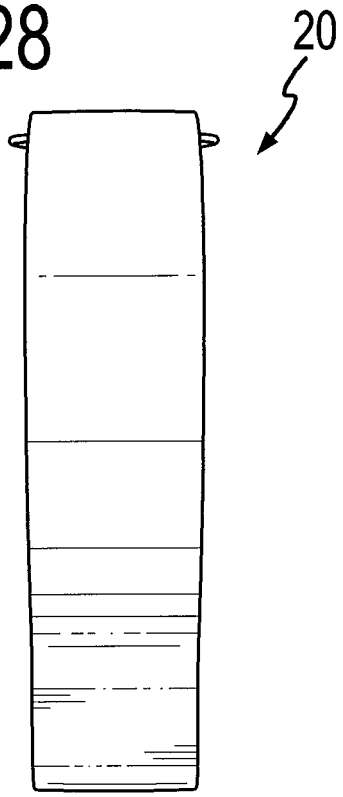
FIG. 28 is an enlarged opposite side elevation view of the device.
Figure 29:
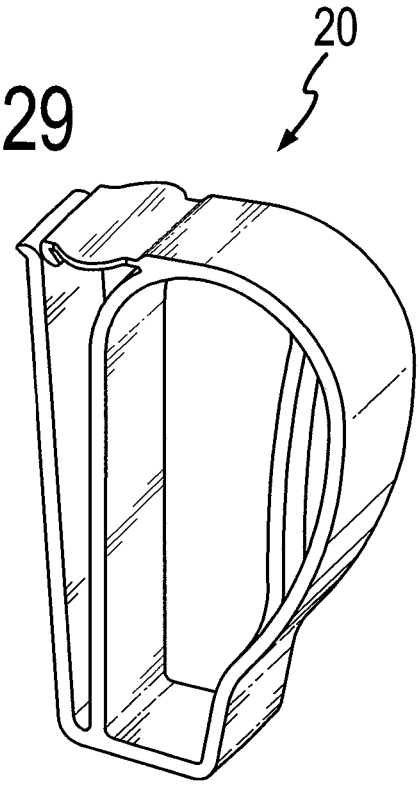
FIG. 29 is an enlarged perspective view of the device.
Figure 30:
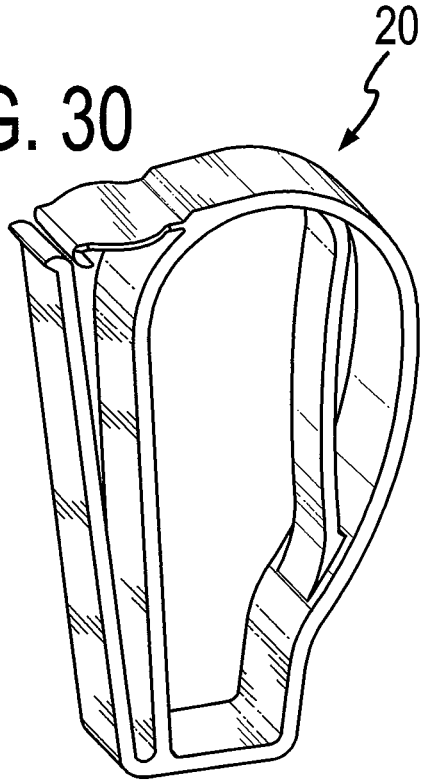
FIG. 30 is an enlarged opposite perspective view of the device.

FIG. 21 is perspective view of an embodiment of device 20 without a connector, generally designated as 120. FIG. 22 is a front elevation view of the device of FIG. 21, and FIG. 23 is a front elevation view showing the device of FIG. 21 and the sleeve 600 and drinking container 500. While connection of handle 22 to sleeve 600 and drinking container 500 is not as firm, this embodiment can be useful in some applications. Retainer 24 is inserted between sleeve 600 and drinking container 500 as in FIGS. 14 and 15, with the exception that there is no need to engage a connector. Also, since retainer 24 is already spaced apart from handle 22, there is no need to cause that separation.

FIGS. 24-30 show enlarged views of device 20. Also, referring to FIG. 3, drinking container 500 has a rim 504.

In terms of use, a method for drinking includes: (refer to FIGS. 1-23)

(a) providing a drinking container 500 having an outside surface 502;

(b) providing a sleeve 600 which is shaped and dimensioned to fit around the outside surface 502 of the drinking container 500, the sleeve 600 having an outside surface 602 and an inside surface 604;

(c) providing a device 20 for holding the drinking container 500, the device 20 including:

a handle 22; and, a retainer 24 having a proximal end 26 which is connected to the handle 22 and an opposite distal end 28, the retainer 24 positionable between the outside surface 502 of the drinking container 500 and the inside surface 604 of the sleeve 600;

(d) positioning the sleeve 600 around the outside surface 502 of the drinking container 500;

(e) inserting the retainer 24 between the outside surface 502 of the drinking container 500 and the inside surface 604 of the sleeve 600; and, (f) using the handle 22 to drink out of the drinking container 500.

The method further including:

in (c), the distal end 28 of the retainer 24 being resiliently movable away from the handle 22; and, prior to (e), moving the distal end 28 of the retainer 24 away from the handle 22.

The method of further including:

in (c), the device 20 including a connector 34 which is configured to removably connect the distal end 28 of the retainer 24 to the handle 22; and, after (e), using the connector 34 to connect the distal end 28 of the retainer 24 to the handle 22.

The method further including:

in (c), the connector 34 including a first hook 36 disposed on the handle 22, and a second hook 38 disposed at the distal end 28 of the retainer 24; and, in (c), the first hook 36 and second hook 38 having an engaged position wherein the distal end 28 of the retainer 24 is connected to the handle 22, and a disengaged position wherein the distal end 28 of the retainer 24 is disconnected from the handle 22.

The method further including:

in (c), the connector 34 including a lifting tab 40 for lifting the first hook 36 to place the first 36 hook 36 and second 38 hook 38 in the disengaged position; and, before (e), using the lifting tab 40 to place the connector 34 in the disengaged position.

The method further including:

in (b), the sleeve 600 having an aperture 610; and, after (e), positioning the connector 34 through the aperture 610 in the sleeve 600.

The method further including:

in (c), providing a second retainer 30 which is connected to the handle 22, the second retainer 30 configured to abut the outside surface 602 of the sleeve 600;

in (c), the retainer 24 and the second retainer 30 forming a space 32 therebetween which is configured to receive the sleeve 600; and, in (e), the sleeve 600 received by the space 32.

The method further including:

providing a support surface 800;

in (c), the handle 22 having a flat bottom 25; and, after (f), placing the drinking container 500 upon the support surface 800 wherein the flat bottom 25 resides upon the support surface 800.

It is noted that the order of performance of the above cited method steps can be changed as appropriate.

The embodiments of the device for holding a drinking container and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method should be construed as limiting the invention to a particular embodiment or combination of embodiments. The scope of the invention is defined by the appended claims.

I claim:

1. A system for holding a drinking container, the drinking container having an outside surface and a rim, the system comprising:

a sleeve which is positionable to girdle the outside surface of the drinking container, said sleeve having an outside surface and an inside surface a handle;

a retainer having a proximal end which is connected to said handle and an opposite distal end, said retainer positionable between the outside surface of the drinking container and said inside surface of said sleeve;

a connector which is configured to removably connect said distal end of said retainer to said handle;

said connector including a first hook disposed on said handle, and a second hook disposed at said distal end of said retainer;

said first and second hooks having (1) an engaged position wherein said first hook engages said second hook and said distal end of said retainer is connected to said handle, and (2) a disengaged position wherein said first hook is disengaged from said second hook and said distal end of said retainer is disconnected from said handle;

a second retainer which is connected to said handle, said second retainer configured to abut said outside surface of said sleeve;

said retainer and said second retainer forming a space therebetween which is configured to receive said sleeve;

said sleeve having an aperture which extends from said outside surface of said sleeve to said inside surface of said sleeve; and, said first hook of said connector positionable through said aperture in said sleeve.

* * * * *